United States Patent [19]

Hiranuma et al.

[11] Patent Number: 4,580,889

[45] Date of Patent: Apr. 8, 1986

[54] COLOR IMAGE REPRODUCTION APPARATUS

[75] Inventors: Susumu Hiranuma; Michio Hiraga, both of Ebina, Japan

[73] Assignee: Fuji Xerox Co., Ltd., Tokyo, Japan

[21] Appl. No.: 678,517

[22] Filed: Dec. 5, 1984

[30] Foreign Application Priority Data

Jun. 8, 1984 [JP] Japan ..... 59-117702

[51] Int. Cl.[3] ..... G03G 15/01

[52] U.S. Cl. ..... 355/4; 355/3 DR; 355/3 TR; 355/14 TR; 118/645; 430/357; 430/363

[58] Field of Search ..... 355/4, 3 R, 3 TR, 3 DR, 355/14 TR; 382/17; 350/DIG. 1, 397; 118/645; 430/357, 363

[56] References Cited

U.S. PATENT DOCUMENTS

| | | | |
|---|---|---|---|
| 3,690,756 | 9/1972 | Smith | 355/4 |
| 4,371,253 | 2/1983 | Day et al. | 355/4 |
| 4,403,848 | 9/1983 | Snelling | 355/4 |
| 4,479,242 | 10/1984 | Kurata | 355/4 X |
| 4,515,462 | 5/1985 | Yoneda | 355/4 |

*Primary Examiner*—A. C. Prescott

*Attorney, Agent, or Firm*—Armstrong, Nikaido, Marmelstein & Kubovcik

[57] ABSTRACT

A color image reproduction apparatus capable of producing a polychromatic reproduction of a color original is disclosed. The apparatus includes a light scanner for scanning the color original to be reproduced to thereby form a light image. A prism or a plurality of color filters are arranged for color-separating the light image into red, green and blue light images and a memory is provided for memorizing those color-separated light images. A plurality of marking units are arranged around a transfer drum carrying a copy paper thereon and cyan, magenta and yellow toner images are formed by the respective marking units and toner images are transferred onto the copy paper in substantially perfect registration. The drive timing of each marking unit in response to conveying timing of the copy paper is controlled by a system controller.

4 Claims, 5 Drawing Figures

COLOR IMAGE REPRODUCTION APPARATUS

BACKGROUND OF THE INVENTION

This invention relates to a full color image reproduction or recording apparatus which is capable of reproducing full color image with great speed.

In conventional electrophotography or xerography, a photosensitive plate, consisting of photo conductive member placed upon a conductive backing, is uniformly charged and the plate is then exposed to a light image containing original subject matter to be reproduced. Under the influence of the light image, the charge on the photoconductive member is selectively dissipated in the light stuck regions thereby producing latent electrostatic image of the original. The charged latent electrostatic image is then developed by bringing oppositely charged, finely divided electroscopic marking particles called toner into operative communication with the plate in a manner so that the toner particles are attracted into the imaged regions. After development, the visible image is transferred to a final support material, such as paper or the like, and the image affixed thereto to form a permanent record of the original.

The basic electrophotographic process can be adapted to produce full color reproductions by using well known subtractive color printing techniques. It is conventional, in the electrophotographic system, to first color separate the original into the primary color components of red, green and blue. Each component is then used to record a separate latent electrostatic image on the surface of a photoconductive plate and the images are developed with toners containing colorants that are the complements of the primary colors recorded. The recorded red, green and blue color components are developed with toner containing the colorants of cyan, magenta and yellow. Each developed image is individually transferred to a sheet of final support material to create a full color rendition of the original.

Because of inherent limitations found in most known colorants, it is generally necessary to employ costly and complex masking and/or balancing techniques to achive a faithfull color reproduction. Furthermore, because of the number of exposure and transfer operations invloved, registration is also a problem in this type of system. Any disadvantages that might be associated with the subtractive color printing process are certainly offset by the quality of the full color renditions produced.

Hitherto various color reproduction method and apparatus have been proposed and some are actually reduced to commercial products. One of these machines is shown in FIG. 1. Referring to FIG. 1, a conventional multicolor image recording apparatus comprises a platen 32 for mounting a color original 31 thereon, a drive mechanism 33 for reciprocating the platen 32 upon scanning under the original 31 mounted condition, a motor 34 as a drive source of the drive mechanism 33, a scanning unit 35 for projecting light to the original 31 upon scanning and converging reflective light from the original 31 through a filter to a predetermined position, a phtosensitive drum 36 for receiving the light from the scanning unit 35 and forming latent images for cyan, magenta and yellow during three rotations thereof, a charging unit 37 for uniformly charging a surface of the photosensitive drum 36 prior to exposure, developing units 38*a*, 38*b* and 38*c* for developing cyan, magenta and yellow images during three rotations of the drum by adhering toners of each color to the latent images formed on the photosensitive drum 36 to form a visible image, a motor 39 for driving the phtosensitive drum 36, a paper supply cassette 40 for storing many copy papers 60 of required size, a paper feed belt 41 for feeding only one paper from the paper supply cassette 40 at a timing when the visible image reaches a transfer position, a motor 42 for driving the belt 41, a feed roller 43 for feeding the supplied paper to the transfer position, a transferring unit 44 for transferring the visible image from the surface of the photosensitive drum 36 to the paper 60 fed to the transfer position, a fixing unit 45 for fixing a transferred toner image on the copy paper, a cleaner 46 for removing residual toner adhered to the surface to the photosensitive drum 36 after transferring, and a delivery tray 47 for receiving a copied paper 61 after being fixed.

In the above-mentioned arrangement, when the color original 31 is mounted on the platen 32, and copying conditions are set at a consolo (not shown) to press a start button, the motors 34 and 39, charging unit 37, transferring unit 44 and fixing unit 45 are driven. When the motor 34 is rotated, the platen 32 is started to run and lamp in the scanning unit 35 is turned on to form a first latent image through a red filter onto the surface of the photosensitive drum 36 charged by the charging unit 37. Then, the developing unit 38*a* is selected to carry out developing by adhering cyan toner onto a surface of the latent image, and in turn, the copy paper fed by the paper feed belt 41 is wrapped around a transfer drum of the transferring unit 44 to carry out transferring. After transferring, residual toner on the surface of the drum is removed, and charging is carried out again. At this time, a green filter is inserted in a light path of the scanning unit 35, and the developing unit 38*b* is selected to carry out developing by adhering magenta toner onto a surface of a latent image. Then, the magenta image is transferred to the copy paper wrapped around the transfer drum with the cyan image registered with the magenta image to form a mixed color image of the two colors. Next, subsequent scanning and exposing are carried out by using a blue filter, and the developing unit 38*c* is selected to adhere yellow toner onto a surface of a latent image, thereafter to carry out transferring, thus printing a mixed color image of the three colors. Then, the copied paper is separated from the transfer drum and is fed to the fixing unit 45, and after fixing, it is delivered to the delivery tray 47, thus completing full color copying by a one-drum three-color developing device.

The fact that the above-described process entails three sequential light scanning steps to sequentially expose the photoconductive surfaces is obviously disadvantageous from several standpoints. Since the light source must be energized three times for each full color reproduction, the number of copies which can be made from a given light source is reduced as well by a factor of three and the power requirement for each copy is increased by the same factor. The copy output capability is significantly and adversely affected since the exposure time is a rate limiting factor for any given electrophotographic copying system.

In order to improve the above noted problems, an improved color reproduction system is disclosed in U.S. Pat. No. 3,690,756. The important features of this patented invention include the provision of an optical system which uses the light images produced by a single scanning of a color original to simultaneously form color separation images on three different photoconductive areas. The light image formed by scanning the original copy is passed through a focusing lens assembly and is separated by beam splitters into at least three light beams which are color filtered and conducted along optical paths of equal lengths to expose separate photoconductive areas and thereby record the respective color separation images. The essential part of the patented invention is that a single light scanning of the original can be employed to simultaneously produce three or more color separation images on three or more separate photoconductive areas, thus overcoming the difficulties inherent in known reproduction systems which requires a separate light scanning step for each color separation image.

In the former prior art apparatus, however, although registration error or shift due to mechanical deformation or slippage is hardly generated by using a transfer drum supported by a rigid flange, the photosensitive drum must be rotated three times for making full color copy, thereby causing a recording speed to be disadvantageously reduced.

In the latter prior art device, when a belt is used as a feeding means, there occurs expansion and contraction, waving, deviation and slippage, etc. of the belt. Further, when a chain is used as the feeding means, there occurs vibration and expansion, etc. of the chain. As a result, registration shift is apt to be created. Additionally, as a plurality of marking units (combination of photosensitive drums, developing units, charging units and cleaners) are arranged in a line, size of the recording device in the direction becomes large at least times of the number of each marking unit, and accordingly, it is difficult to make the device compact.

SUMMARY OF THE INVENTION

It is therefore an object of the present invention to provide a color reproduction apparatus which is capable of producing a polychromatic reproduction of a color original with a great speed.

Another object of the present invention is to provide a color reproduction apparatus which employs a plurality of marking units arranged around a transfer drum and in which color separated light images are temporarily stored in a memory unit and then read successively to drive the respective marking units in response to coveying timing of a copy paper.

In accordance with an aspect of the present invention, there is provided a color image reproduction apparatus capable of producing a polychromatic reproduction of a color original, comprising: light scanning means for forming a light image of the color original; means for color-separating the light image into red, green and blue light images; memory menas for storing the red, green and blue light images; transfer drum means for carrying a copy receiving material attached thereon; a plurality of marking units arranged around said transfer drum means, each marking unit including a photosensitive drum, charge means, raster output scanner means, developing means and cleaning means; controller means for controlling the drive timing of said respective marking units in response to the conveying timing of the copy receiving material thereby forming color toner images on the respective photosensitive drums based on red, green and blue light images stored in said memory means; and a plurality of transfer means each for tranferring color toner image formed by said respective marking units to the copy receiving material on said transfer drum means whereby a composite color image is formed in substantially perfect registration of respective color toner images.

The above and other objects, features and advantages of the present invention will become readily apparent from the following description taken in conjunction with the accompanying drawings.

PREFERRED EMBODIMENT OF THE INVENTION

The multicolor image recording apparatus of the present invention will now be described below in detail.

Figure 1:
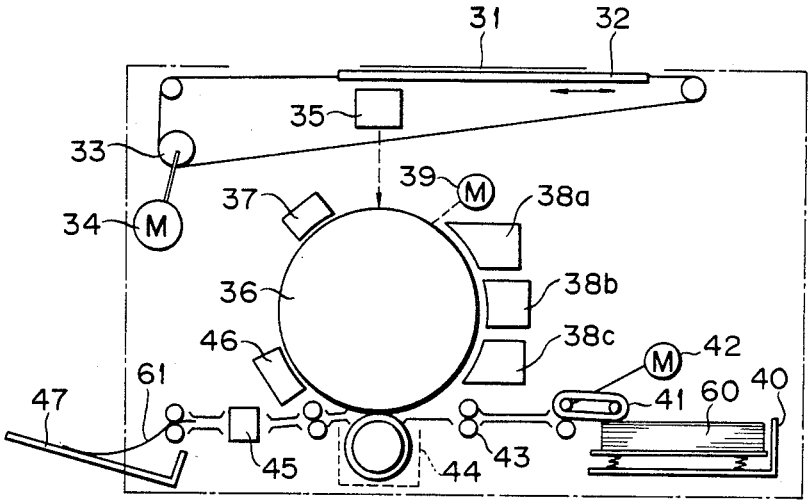
FIG. 1 PRIOR ART
FIG. 1 is a schematic illustration of a conventional color copying apparatus.
Figure 2:
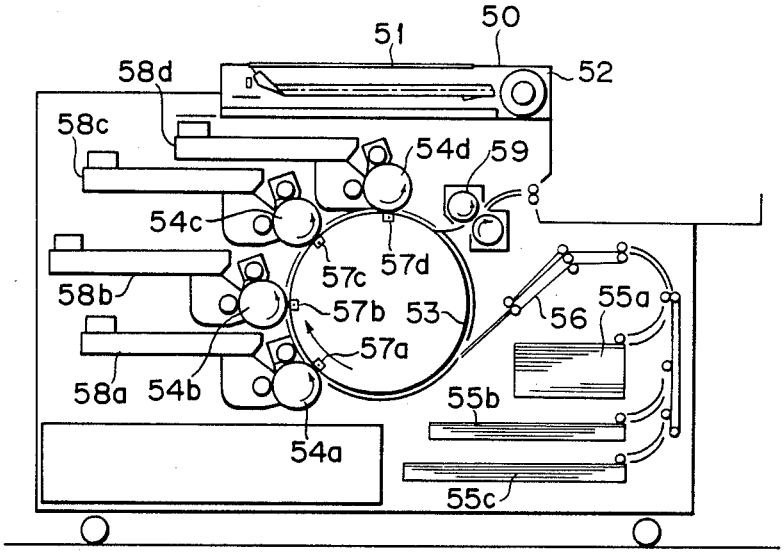
FIG. 2 is a schematic side elevation of a preferred embodiment according to the present invention.

Referring first to FIG. 2 which shows a preferred embodiment of the present invention, the multiclolor image recording apparatus comprises an image sensor 52 for reading contents of a color original 51 mounted on a platen 50 sequentially in a lateral direction thereof and converting light to electricity, a transfer drum 53 rotating at a predetermined speed with a copy paper wrapped therearound upon transferring and permitted to move in a fixed direction, a plurality of marking units 54*a*–54*d* arranged on about half of an outer circumference of the transfer drum 53 at predetermined intervals and permitted to come into contact therewith, a plurality of paper trays 55*a*–55*c* for storing many copy papers of different size, a paper feeding passage 56 for feeding the paper supplied from any one of the paper trays to the transfer drum 53, a plurality of transfer corotrons 57*a*–57*d* provided at positions opposite to the marking units 54*a*–54*d* on an inside of the transfer drum 53, a plurality of laser raster output scanners 58*a*–58*d* for photo-modulating beam of excited information including separated color components to be recorded composed of cyan, magenta, yellow and black in image information from the image sensor 52 and exposing photosensitive drums of the marking units, and a fixing unit 59 for fixing a copy paper separated from the transfer drum 53 after completion of transferring from the marking units 54*a*–54*d*.

Figure 3:
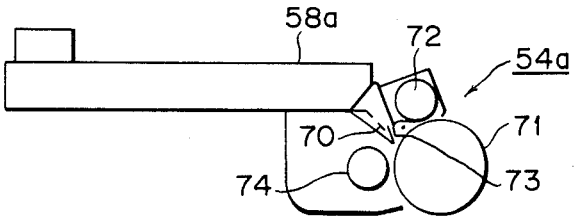
FIG. 3 is an enlarged side elevation of the marking unit as shown in FIG. 2.

Referring next to FIG. 3 which shows the marking unit 54*a* in detail, the marking unit 54 comprises a photosensitive drum 71 arranged so as to come into contact with the transfer drum 53 and formed with a photosensitive layer on a surface thereof, the photosensitive drum being exposed by laser beam 70 generated from the laser raster output scanner 58*a*, a cleaner 72 for removing residual toner adhered to the surface of the drum 71 upon previous transferring, a charging corotron 73 for charging the photosensitive layer cleaned by the cleaner, and a developing unit 74 for developing a latent image formed by exposure of the laser beam 70 by adhering any one of cyan, magenta, yellow and black toners.

Figure 4:
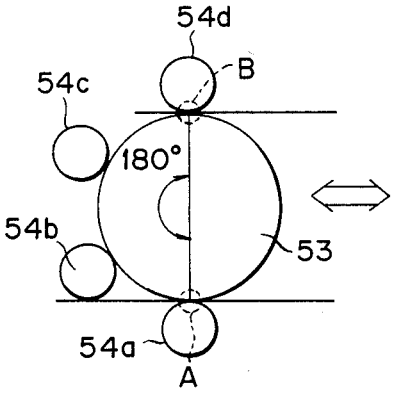
FIG. 4 is a view explanatory of an arrangement of the marking units and the transfer drum.

Further, it is preferable to allow each of the marking units to be separated from the transfer drum 53 for check of paper jamming or maintenance, etc. In this case, any sides may be moved, but it is preferred that the transfer drum 53 is moved for purpose of simplicity of construction. To this end, as shown in FIG. 4, it is necessary to set at 180° or less an angle formed by the line lying on a transfer position A of the first marking unit 54*a*, a transfer position B of the fourth marking unit 54*d* and a center of rotation of the transfer drum 53. If both the marking units are arranged at an angle more than the above-set angle, the transfer drum 53 cannot be taken out.

Figure 5:
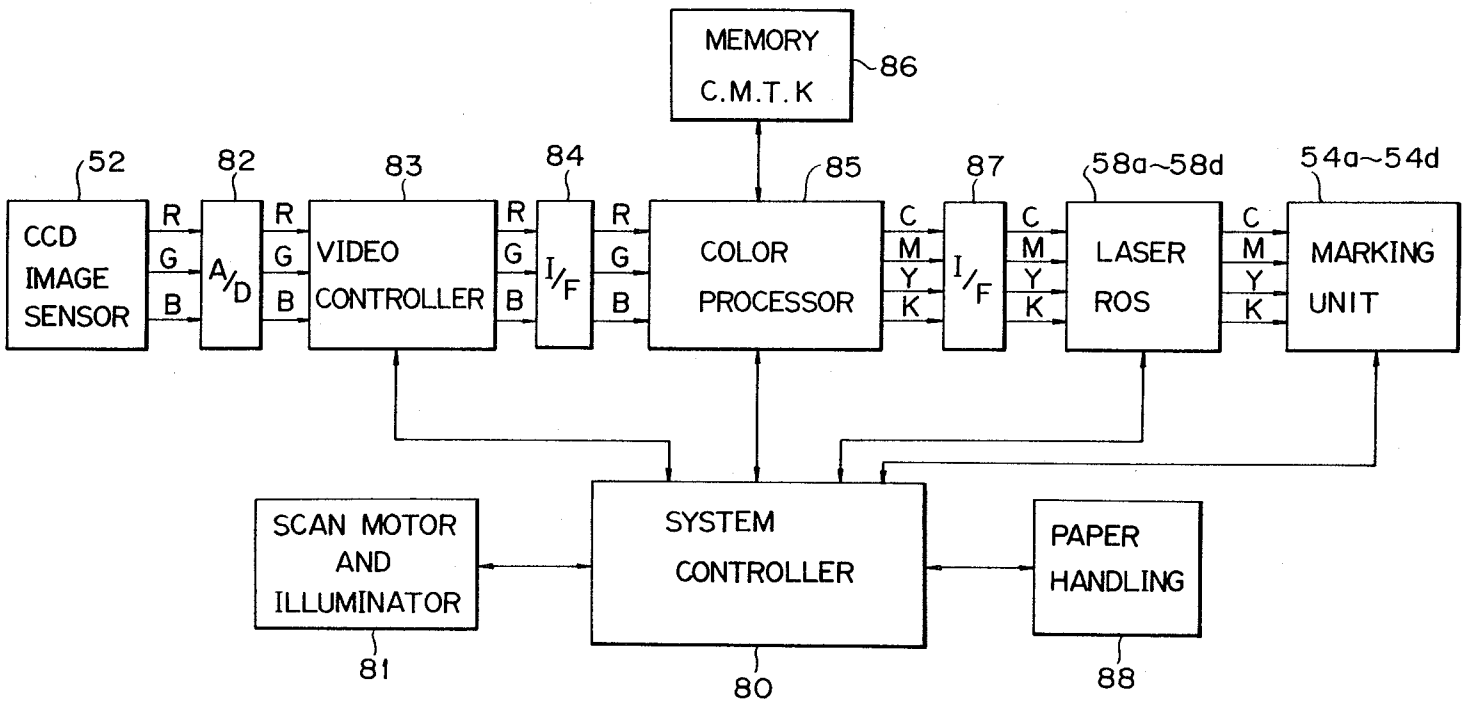
FIG. 5 is a block diagram explanatory of color image formation according to the present invention.

In operation, referring to FIG. 5 which shows a block diagram of the operation of the present invention, when a copy start button is pressed by an operator, a signal is sent out from a system controller 80 to a scan motor and illuminator 81. At the same time when the illuminator 81 is turned on, the scan motor is started to drive and scanning exposure of the original 51 is started. A scanning exposure optical system, which is not specifically shown, includes a mirror and a lens, and light emitted from the lens is separated to the three primary colors, namely red, green and blue by a prism arranged on the downstream side of the lens. Each of the separated colors are incident upon three CCD image sensors 52 corresponding to the three primary colors. Signals from the CCD image sensors 52 are converted from analog to digital by an A/D converter 82 and are fed into a video controller 83, which series to correct variation in signals and control timing of signals. Output signals from the video controller 83 are inputted through an interface 84 to a color processor 85, in which each signal of the three primary colors, red, green and blue is converted to corresponding signals of cyan, magenta and yellow as a coloring agent and signal of black, and is temporarily stored in a memory 86.

On the other hand, another signal is generated from the system controller 80 to a paper handling 88 to supply a copy paper of selected size from any one of the paper trays 55*a* to 55*c*. The copy paper fed through the copy paper feeding passage 56 is adhered to the surface of the transfer drum 53 by an electrostatic attraction force, etc., and is rotated with rotation of the transfer drum 53. When a forward end of the paper reaches a certain position, a signal is outputted from the system controller 80 to the color processor 85 at a predetermined timing to read information in the memory 86. The read information from the memory 86 is inputted through the color processor 85 and an interface 87 to a laser ROS (Raster Output Scanner) 58*a*. As a result laser beam is generated from the laser ROS 58*a*, thus carrying out formation of latent image by laser exposing on the basis of image information of red component in the marking unit 54*a* and developing by a cyan toner. Then, the first transferring of cyan image is carried out to the copy paper on the transfer drum 53.

At a timing when the cyan image reaches a position near the marking unit 54*b*, a signal is outputted from the system controller 80 to the color processer 85, and in the same process as above described, laser exposing by the laser ROS 58*b* is carried out in the marking unit 54*b* on the basis of image information of green component to form a latent image. The latent image is developed by a magenta toner to carry out the second transferring on the copy paper. Thus, a mixed color image of the two colors is formed on the copy paper. Subsequently, at a timing when the copy paper reaches a position near the marking unit 54*c*, a signal is outputted from the system controller 80 to the color processor 85, and in the same process as above described, laser exposing by the laser ROS 58*c* is carried out in the marking unit 54*c* on the basis of image information of blue component to form a latent image. This latent image is developed by a yellow toner, and this toner image is registered with the aforementioned mixed color image to be transferred on the copy paper, thus obtaining a mixed color image of the three colors. Thereafter, at a timing when the transferred image of cyan magenta and yellow reaches a position near the marking unit 54*d*, a signal is outputted from the system controller 80 to the color processor 85, and in the same process as above mentioned, laser beam exposure by the laser ROS 58*d* is carried out on the basis of image information of black component to form a latent image, which is in turn developed by a black toner and is then transferred to the copy paper. After completion of the whole transferring process, the copy paper is separated from the surface of the transfer drum 53, and is fed to the fixing unit 59 for a fixing process, thereby obtaining a hard copy of full color.

In the above described preferred embodiment, the exposing process is carried out by using the laser system for purposes of reduction in space and size of the device. However, in substitution of the laser system, a light lens optical system or any elements such as LED and LCD may be used.

Further, in this embodiment, the corotron transferring type as a transferring system is disclosed, but it is also possible to use such systems as disclosed in Japanese Patent Laid-Open Nos. 53-96837 and 53-96838, using a belt formed in a drum-like shape.

As is above described, according to the multicolor image recording apparatus of the present invention, a plurality of marking units are arranged on an outer circumference of the transfer drum at a predetermined intervals to sequentially conduct a transferring process at a predetermined timing, thereby permitting a high speed recording, and the copy paper is fed by the transfer drum supported by the rigid flange, thereby increasing accuracy of registration.

While the invention has been described and shown with particular reference to the preferred embodiment, it will be apparent that variations might be possible that would fall within the scope of the present invention which is not intended to be limited except as defined in the following claims.

What is claimed is:

1. A color image reproduction apparatus capable of producing a polychromatic reproduction of a color original, comprising:

light scanning means for forming a light image of the color original;

means for color-separating the light image into red, green and blue light images;

memory means for storing the red, green and blue light images;

transfer drum means for carrying a copy receiving material attached thereon;

a plurality of marking units arranged around said transfer drum means, each marking unit including a photosensitive drum, charge means, raster output scanner means, developing means and cleaning means;

controller means for controlling the drive timing of said respective marking units in response to the conveying timing of the copy receiving material thereby forming color toner images on the respective photosensitive drums based on red, green and blue light images stored in said memory means; and a plurality of transfer means each for transferring color toner image formed by said respective marking units to the copy receiving material on said transfer drum means whereby a composite color image is formed in substantially perfect registration of respective color toner images.

2. A color image reproduction apparatus according to claim 1 wherein said plurality of marking units comprises a first marking unit for producing a cyan toner image based on the red light image stored in said memory, a second marking unit for producing a magenta toner image based on the green light image and a third marking unit for producing a yellow toner image based on the blue light image.

3. A color image reproduction apparatus according to claim 1 wherein said plurality of marking units are so arranged that the angle formed by the center of said transfer drum means and the centers of the photosensitive drums of the ends most marking units is less than 180°.

4. A color image reproduction apparatus according to claim 1 wherein said transfer drum means has both ends supporting sections each made of a rigid cylindrical member.

* * * * *